US005226560A

United States Patent [19]

Jones

[11] Patent Number: 5,226,560

[45] Date of Patent: Jul. 13, 1993

[54] PRESSURE FOOT FOR USE AS BAG SAVER APPARATUS FOR DISPENSING TAPED BAGS AND PROCESS THEREFOR

[75] Inventor: Kennie L. Jones, Iowa Park, Tex.

[73] Assignee: W. R. Grace & Co.-Conn., Duncan, S.C.

[21] Appl. No.: 960,619

[22] Filed: Oct. 14, 1992

[51] Int. Cl.[5] ..... B65H 5/28

[52] U.S. Cl. ..... 221/70; 242/55.53

[58] Field of Search ..... 221/311, 312 R, 77, 221/78, 84, 70, 71, 72, 73, 74; 242/55.53, 67.3 R; 248/451, 452, 453; 312/34.8, 91

[56] References Cited

U.S. PATENT DOCUMENTS 3,369,952 2/1968 Rieger ..... 221/73 X 3,692,176 9/1972 Templeton et al. ..... 221/70 X 4,094,438 6/1978 Neubauer ..... 221/71 X 4,526,362 7/1985 Thierstein ..... 242/67.3 R X

FOREIGN PATENT DOCUMENTS 671745 9/1989 Switzerland .

*Primary Examiner*—H. Grant Skaggs

*Assistant Examiner*—Dean A. Reichard

*Attorney, Agent, or Firm*—William D. Lee, Jr.; Mark B. Quatt; Leigh P. Gregory

[57] ABSTRACT

Disclosed is a pressure foot designed to help maintain imbricated bags in a lined up relationship at the open mouth end of a dispensing container carton, as the bags are being dispensed from the open mouth end of the container carton, and a method therefor.

14 Claims, 2 Drawing Sheets

PRESSURE FOOT FOR USE AS BAG SAVER APPARATUS FOR DISPENSING TAPED BAGS AND PROCESS THEREFOR

FIELD OF THE INVENTION

The present invention relates to a device for a dispensing system and to a process for aiding in sequentially removing flexible bags from a chain wherein the bags are successively adhered in imbricated fashion to at least one tape. More particularly, the present invention relates to a pressure foot designed to help maintain imbricated bags in a lined up relationship at the open mouth end of a dispensing container carton, as the bags are being dispensed from the open mouth end of the container carton, and a method therefor.

BACKGROUND OF THE INVENTION

An important role exists in the economy with regard to packaging of goods, particularly food, in flexible, thermoplastic bags. The ultimate cost of packaged goods to the consumer is dependent upon how available low cost efficient packaging methods and devices are. This includes auxiliary components employed in the packaging. Many consumer products, such as meat, are packaged in bags supplied as a chain of imbricated taped bags. The bags are in overlying, shingled relationship and adhered to one or more strands of tape. Imbricated bags and tape pulling units for automatically dispensing taped bags are shown in U.S. Pat. No 3,587,843 (Wing) and U.S. Pat. No. 3,698,547 (Roberts). Background on dispensing is disclosed in U.S. Pat. No. 3,702,672 (Becht), which discloses an arcuate head and friction bar that aids in manually dispensing flexible thermoplastic bags from a perforated roll. Also background, U.S. Pat. No. 3,554,447 (Sebring) discloses use of a stripper plate for detaching envelopes from a carrier web and U.S. Pat. No. 3,918,661 (Kishi et al.) discloses a paper roll holder having a lid abutting on the roll.

More relevant are U.S. Pat. No. 4,611,728 (Compton and Thomas), U.S. Pat. No. 4,113,139 (Berry and Hall), and U.S. Pat. No. 4,032,038 (Hendricks, Howe, Lock, Morris, and Owen). More particularly, U.S. Pat. No. 4,611,728 involves a package of imbricated bags including a chain of adhesively imbricated bags in overlying sequence, each bag being adhesively but releaseably attached to adjacent bags and having an open mouth end directed toward the leading end of the chain. Also is shown a container for the chain having an elongate, constricted opening through which the leading end of the chain is directed. The length of the opening is less than the bag chain width by a selected extent sufficient to cause the mouth of each bag to open in response to transverse constriction as the chain is advanced through the opening. U.S. Pat. No. 4,113,139 involves a chain of imbricated bags connected and supported by a carrier removably secured to the closed end of each of the bags. The carrier is used for individually dispensing the leading bag when the carrier is moved in a direction which advances the sealed end of the bag ahead of the opened end. U.S. Pat. No. 4,032,038 involves a device useful for dispensing taped bags including spaced apart rotatably mounted carriers, a surface therebetween to wind up at least one tape, and a clutch assembly for unidirectional rotation of the wind up surface. In various embodiments, the device further includes a variety of features which facilitates removal of wound up tape. The device is useful when employed as a component of an apparatus having a housing for supporting a supply of taped bags. Also is disclosed a process useful for removing flexible thermoplastic bags in imbricated relationship from a chain having at least one bag-connecting tape. The process includes securing the tape to a reel, rotating the reel (A) to withdraw the leading bag from a supply, (B) to wind up a portion of the tape, and (C) to create tension on the tape, and then manually removing at least the leading bag from the tension tape, repeating the two preceding operations, and thereafter removing the resulting accumulated tape The disclosures of all the above-mentioned patents are incorporated herein by reference.

Although large volume packagers can advantageously utilize automated dispensing systems for taped bags, many taped bag dispensing operations are performed manually by a human operator, especially for lower volume taped bag users. Heretofore, known dispensing devices and processes have not entirely satisfactorily satisfied this need. It has now been found by practice of the instant invention that numerous deficiencies of the prior art are overcome in a simple, economical, and efficient manner.

OBJECTIVES AND ADVANTAGES

The present invention helps alleviate the problem of several bags sticking together as taped imbricated bags are being dispensed from a dispensing carton. This helps minimize bag loss due to multiple dispensing. It is noted that multiple dispensing is more predominant with patched bags as the patch makes the bag thicker and increases the weight of the bags, which often causes hard creases or folds at various locations within the chain of bags located inside the dispensing carton. For clarity so that it is understood what is meant by a patched bag, it is noted that patched bags are illustrated in U.S. Pat. No.4,755,403 (Ferguson), the disclosure of which is incorporated herein by reference. When multiple bags stick together as they are being dispensed from a dispensing carton, the weight of the bags causes the multiple bags to fall forward and off the carrying tapes and onto the floor. The bags will then be removed from the floor and thrown away. If some of the multiple bags do not release from the tape, they will hang down thus interfering with the person who is loading product into the bag. These and other problems are alleviated by the instant invention. It is also to be understood that although the instant pressure foot invention is particularly useful for when a human operator is by hand removing the lead bag as taped imbricated bags are being dispensed from the open mouth of a carton, the instant invention may also be used in conjunction with bag dispensing apparatus, such as illustrated by the above-mentioned U.S. Pat. No. 4,032,038 (Hendricks et al.) and U.S. Pat. No. 4,113,139 (Berry et al.).

SUMMARY OF THE INVENTION

The present invention provides a pressure foot device for maintaining an imbricated chain of bags in a lined up relationship as said bags are being dispensed via a lead bag from a carton, said carton being a dispensing carton having an open mouth end, said device comprising a foot, a shaft and a bearing, said foot being hingedly attached to said shaft, said bearing having an aperture, whereby said shaft is slidably engaged with said bearing, whereby said foot via gravity, when in flush relationship with said lead bag, will maintain said imbricated chain of bags in a lined up relationship at the open mouth end of the dispensing carton, as said bags are being dispensed via a lead bag from said open mouth end of said dispensing carton. Preferably, the hinged attachment allows arcuate movement of about 90° of the foot with respect to the shaft. The device may be attached to a holding means to hold it proximate the open mouth end, such as attached to a bar via a clamp and screw, the clamp being slidable along the bar so that the device can be centered in front of the lead bag at the open mouth end. The bags should be secured in imbricated relationship in the chain by at least one carrier tape.

The present invention also provides a method for maintaining an imbricated chain of bags in a lined up relationship as said bags are being dispensed via a lead bag from a carton, said carton being a dispensing carton having an open mouth end, said method comprising (a) placing proximate the open mouth end, a pressure foot device having a foot, a shaft and a bearing, wherein said foot is hingedly attached to said shaft, and wherein said bearing has an aperture, whereby said shaft is slidably engaged with said bearing, (b) allowing said foot via gravity to come into flush relationship with said lead bag, whereby said foot will maintain said imbricated chain of bags in a lined up relationship at the open mouth end as said bags are being dispensed via a lead bag from said open mouth end of said dispensing carton. Preferably, the hinged attachment allows arcuate movement of about 90° of the foot with respect to the shaft. The device may be attached to a holding means to hold it proximate the open mouth end, such as attached to a bar via a clamp and screw, the clamp being slidable along the bar so that the device can be centered in front of the lead bag at the open mouth end. The bags may be secured in imbricated relationship in the chain by at least one carrier tape.

DETAILED DESCRIPTION

Figure 1:
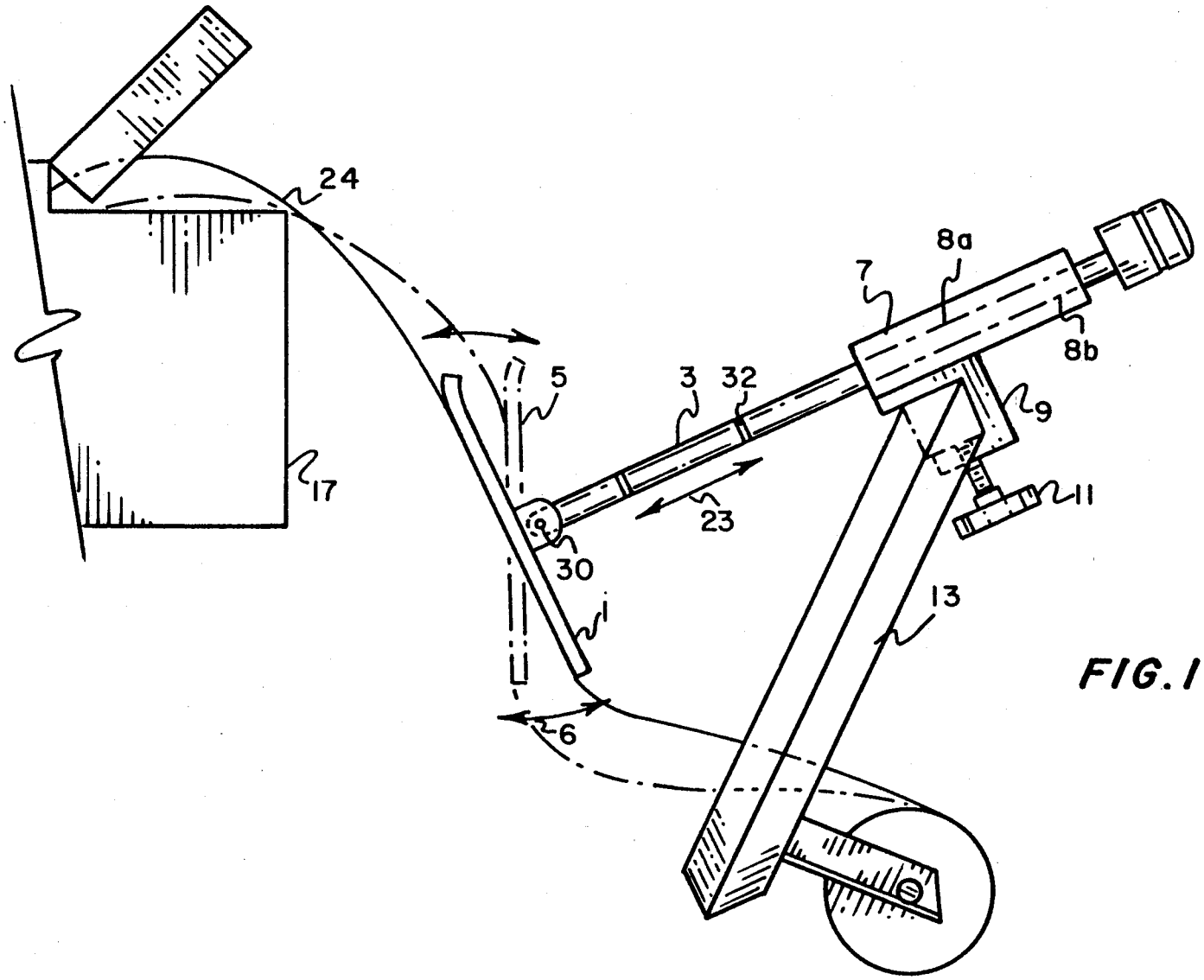
FIG. 1 is a plan view of the pressure foot apparatus of the invention, showing the apparatus connected to a shaft.

More particularly, FIG. 1 shows pressure foot 1 hingedly attached to shaft 3 via hinge 30. Preferably, hinge 30 is an articulating joint. Because of the hinged attachment, pressure foot 1 can achieve an arcuate movement of approximately 90° with respect to shaft 3. This other positioning of foot 1 through arcuate movement is illustrated by dotted line 5 and double-headed arrow 6. Thus, the hinged attachment allows the foot to adjust to the angle of the chain 24 of imbricated bags. Bearing 7 has an aperture illustrated by dotted lines **8*a*, 8*b*, whereby shaft 3 slides up and down inside bearing 7. Bearing 7 has an attachment means, illustrated in the figure as clamp 9 and screw 11 so that it can be attached to some kind of holding means, illustrated in the figure as bar 13**.

Figure 2:
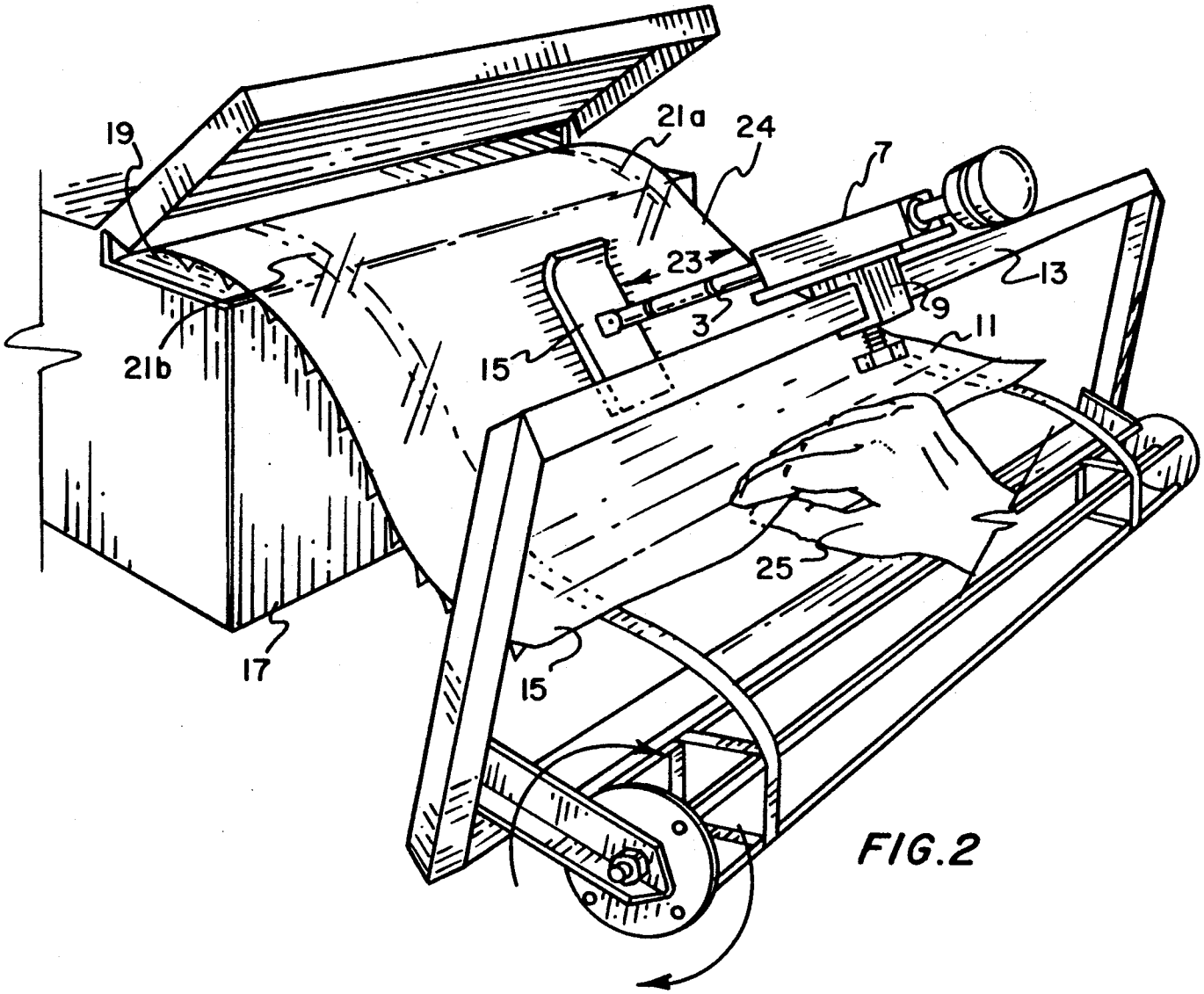
FIG. 2 is a perspective view showing the pressure foot apparatus of FIG. 1 placed over a bag dispensing carton with the foot of the apparatus against a bag as the bag is coming out of the open mouth of the carton.

There is nothing particular about the attachment means 9, 11 or the holding means 13, and this can be devised by the person of ordinary skill in the art without undue experimentation, as the purpose is to have a means onto which the pressure foot device may be fastened so it may be held in front of the open mouth end of the carton from which the imbricated bags are being dispensed, as is further illustrated in FIG. 2. More particularly, the pressure foot device of the instant invention, as illustrated in FIG. 2, is shown fastened via attachment means illustrated by a clamp and screw 9,11 to holding means illustrated by bar 13 so that it is displaced in front of the open mouth 19 of carton 17 through which open mouth imbricated taped bags are dispensed from a chain 24, as illustrated by lead bag 15 releaseably secured to carrier tapes **21*a*, 21*b*. The lead bag 15 is in a chain 24 of imbricated bags in overlying sequence adhesively and releaseably attached via tapes 21*a*, 21*b*. Two tapes are typical in commercial operations; however, it is to be understood that the invention could be used with imbricated bags having one tape or having more than two tapes. Also, in commercial operations, the chain is typically in a festooned disposition (not shown) inside the dispensing carton 17. Also shown is human operator hand 25 which pulls off the lead bag from the taped imbricated bag chain. Foot 1 is shown flush against lead bag 15 as lead bag 15 is coming out of the open mouth 19 of the carton 17. The shaft 3, as it slides up and down inside aperture 8*a*, 8*b* of bearing 7 in the directions illustrated by double arrows 23, operates by gravity. This allows the shaft 3 with the foot 1 hingedly attached thereto to maintain the foot 1 in a flush relationship up and against lead bag 15**.

When the foot is not in use, the following is preferred to keep it out of the way of the carton of imbricated bags, to avoid the human operator having to move the entire assembly out of the way. The shaft 3 is provided with one or more notches 32 which hook onto a pin (not shown) that is inside of the bearing 7 when the shaft 3 is turned to provide locking engagement to hold the shaft-/foot in an up position away from the chain of bags when the apparatus is not in use, for instance, when the operator is starting a new carton of imbricated bags.

A pressure foot bag saver device in accordance with the instant invention has been constructed. The shaft was of cylindrical shape and 8 inches long by ½ inch in diameter. The bearing was a 3¼ inch closed bearing (adjustable). The foot was of plastic and was 3 inches wide by 6 inches long. The ½ inch shaft was milled to allow for a locking device (not illustrated in FIGS. 1 and 2) so that the unit could be locked with the shaft in the up position so that the foot is away from the lead bag, thus allowing the person who was the loading operator easy access for attaching tape from the leader bag to a tape wind-up assembly (also not illustrated in FIGS. 1 and 2). The bearing held the shaft and pressure foot. The bearing was mounted via a movable clamp onto a bar so that the unit could be centered on the bags as they came out of the open mouth of the dispensing carton. The adjustable bearing was used to position the adjustable foot via the slidable shaft, allowing for more or less pressure on the bags as they were being dispensed from the carton.

While certain representative embodiments and details have been shown for the purpose of illustration, numerous modifications to the formulations described above can be made without departing from the invention disclosed.

What is claimed is:

1. A pressure foot device for maintaining an imbricated chain of bags in a lined up relationship as said bags are being dispensed via a lead bag from a carton, said carton being a dispensing carton having an open mouth end, said device comprising a foot, a shaft and a bearing, said foot being hingedly attached via a hinge to said shaft, said bearing having an aperture, whereby said shaft is slidably engaged with said bearing, whereby said foot via gravity, when in flush relationship with said lead bag, will maintain said imbricated chain of bags in a lined up relationship at the open mouth end of the dispensing carton, as said bags are being dispensed via a lead bag from said open mouth end of said dispensing carton.

2. The device of claim 1 wherein the hinged attachment allows arcuate movement of about 90° of the foot with respect to the shaft.

3. The device of claim 1 wherein the device is attached to a holding means to hold it proximate the open mouth end.

4. The device of claim 3 wherein the holding means is a bar and the device is attached to the bar via a clamp and screw, the clamp being slidable along the bar so that the device can be centered in front of the lead bag at the open mouth end.

5. The device of claim 1 wherein the bags are secured in imbricated relationship in the chain by at least one carrier tape.

6. The device of claim 1 wherein the bearing has a pin and the shaft has at least a notch whereby the foot and shaft may be maintained in an up position by locking engagement of the pin and the notch.

7. The device of claim 1 wherein the hinge is an articulating joint.

8. A method for maintaining an imbricated chain of bags in a lined up relationship as said bags are being dispensed via a lead bag from a carton, said carton being a dispensing carton having an open mouth end, said method comprising:

(a) placing proximate the open mouth end, a pressure foot device having a foot, a shaft and a bearing, wherein said foot is hingedly attached via a hinge to said shaft, and wherein said bearing has an aperture, whereby said shaft is slidably engaged with said bearing, (b) allowing said foot via gravity to come into flush relationship with said lead bag, whereby said foot will maintain said imbricated chain of bags in a lined up relationship at the open mouth end as said bags are being dispensed via a lead bag from said open mouth end of said dispensing carton.

9. The method of claim 8 wherein the hinged attachment allows arcuate movement of about 90° of the foot with respect to the shaft.

10. The method of claim 8 wherein the device is attached to a holding means to hold it proximate the open mouth end.

11. The method of claim 10 wherein the holding means is a bar and the device is attached to the bar via a clamp and screw, the clamp being slidable along the bar so that the device can be centered in front of the lead bag at the open mouth end.

12. The method of claim 8 wherein the bags are secured in imbricated relationship in the chain by at least one carrier tape.

13. The method of claim 8 wherein the bearing has a pin and the shaft has at least a notch whereby the foot and shaft may be maintained in an up position by locking engagement of the pin and the notch.

14. The method of claim 8 wherein the hinged attachment is an articulating joint.

* * * * *